US011421498B1

(12) United States Patent
Newton

(10) Patent No.: US 11,421,498 B1
(45) Date of Patent: Aug. 23, 2022

(54) WELL COLUMN PIPE RETRIEVAL TOOL

(71) Applicant: Paul A. Newton, Belle Plaine, KS (US)

(72) Inventor: Paul A. Newton, Belle Plaine, KS (US)

( * ) Notice: Subject to any disclaimer, the term of this patent is extended or adjusted under 35 U.S.C. 154(b) by 0 days.

(21) Appl. No.: 17/532,025

(22) Filed: Nov. 22, 2021

(51) Int. Cl.
*E21B 31/12* (2006.01)

(52) U.S. Cl.
CPC ..... *E21B 31/12* (2013.01)

(58) Field of Classification Search
CPC ..... E21B 31/12; E21B 31/18; E21B 31/20
See application file for complete search history.

(56) References Cited

U.S. PATENT DOCUMENTS 1,558,902 A * 10/1925 Ligon ..... E21B 31/18 294/86.29
3,527,494 A * 9/1970 Furmanb ..... E21B 31/12 294/86.25
3,926,468 A * 12/1975 Kondo ..... B66C 1/48 294/102.1
7,665,785 B1 * 2/2010 Newton ..... E21B 31/12 294/86.29
8,801,068 B2 * 8/2014 Goudy ..... B25J 15/0047 294/196

* cited by examiner

*Primary Examiner* — Christopher J Sebesta
(74) *Attorney, Agent, or Firm* — Kenneth H. Jack; Davis & Jack, LLC

(57) ABSTRACT

A well column pipe retrieval tool incorporating a "U" bracket having a lateral arm and an oppositely lateral arm, wherein the oppositely lateral arm has a fixed segment and a moveable segment; the column pipe retrieval tool further incorporating a column pipe receiving throat which is laterally bounded by the "U" bracket's lateral arm, and which is oppositely laterally bounded by the oppositely lateral arms' moveable segment; the column pipe retrieval tool further incorporating a plurality of pin and angled slide slot combinations which interconnect the oppositely lateral arm's fixed and moveable segments.

15 Claims, 4 Drawing Sheets

WELL COLUMN PIPE RETRIEVAL TOOL

FIELD OF THE INVENTION

This invention relates to tools adapted for grasping and retrieving objects in remote locations. More particularly, this invention relates to such tools which are specially adapted for grasping and retrieving an upper end of a well column pipe which is situated below ground level within a well casing.

BACKGROUND OF THE INVENTION

Tools which are adapted for grasping and retrieving a well column pipe from the hollow bore of a well's casing are known. An example of such tool is disclosed in U.S. Pat. No. 7,665,785 issued Feb. 23, 2010, to Newton, et al. Such tools are known to include pipe wall clamping members which may apply excessive localized clamping pressure against the pipe's wall during use for retrieval, especially where the well's column pipe is composed of plastic. Such excess clamping pressure is known to crush or break the upper end of a plastic well column pipe during pipe retrieving use, undesirably frustrating a pipe retrieval operation by allowing the column pipe to fall from the retrieval tool into the casing.

The instant inventive well column pipe retrieval tool solves or ameliorates the pipe retrieval problems discussed above by providing a "U" bracket component which configures one of its arms to include a specialized moveable lower pipe clamping segment.

BRIEF SUMMARY OF THE INVENTION

The instant inventive well column pipe retrieval tool is intended to be used to upwardly retrieve a column pipe from a well's casing. Where the well's column pipe has broken or separated below ground level, the column pipe must be upwardly extracted in order to restore the function of the well. The inventive column pipe retrieval tool may be lowered upon a tether or rope for engagement with the broken upper end of the column pipe. Upon engagement of the tool with the column pipe, the column pipe may be upwardly towed by the rope to ground level.

A first structural component of the inventive tool comprises an inverted "U" bracket having an upper web having lateral and oppositely lateral ends. Lateral and oppositely lateral arm components of the "U" bracket are respectively fixedly attached to or formed wholly with the web's lateral and oppositely lateral ends. The web and arm components of the "U" bracket advantageously form, define, and bound a downwardly opening pipe wall receiving throat where pipe clamping may be performed.

At least one of the "U" bracket's arms, for example an oppositely laterally positioned arm, is necessarily segmented into portions or components including an upper relatively fixed segment and a lower relatively moveable segment. The fixed segment of such oppositely lateral arm is preferably fixedly attached to or formed wholly with the oppositely lateral end of the "U" bracket's web, such attachment causing the fixed segment to be immoveable with respect to the "U" bracket's web and the "U" bracket's lateral arm.

At least a first pin and slide slot or channel combination is preferably provided as means for moveably attaching the oppositely lateral arm's lower moveable segment to such arm's upper fixed segment. In a suitable embodiment, the slide slot or channel of such combination presents a downwardly sloping surface. Correspondingly, such combination's pin slidably engages such sloping surface while performing an arm segments interconnecting function. The slope of the slide slot preferably extends at an angle which assures that the interconnected moveable segment normally slides both downwardly and inwardly or toward the "U" bracket's throat. The downward and throatward travel bias imposed by the slide slot upon the oppositely lateral arm's moveable segment assures that the pull of gravity upon such segment normally moves the segment toward a broken upper end of column pipe received with the "U" bracket's throat.

In order to enhance frictional contact between the "U" bracket's moveable segment and such column pipe's wall, a multiplicity of knurles, teeth or protuberances are preferably formed upon the moveable segment. Where, for example, such protuberances take the form of "V" edged teeth, each tooth preferably extends toward and into the "U" bracket's throat, such tooth extensions pointing vertexes of the "V" shaped teeth toward the wall of the column pipe received within the tool's throat. In order to maintain pipe gripping friction at points of contact between such tooth configured protuberances while avoiding any excess clamping pressure at the site of any single tooth, a multiplicity of "V" edged teeth are preferably vertically arrayed along an inner edge of the moveable segment.

In most circumstances, the wall of the upper end of a well's broken column pipe extends substantially vertically, such orientation giving rise to a mechanical need for correspondingly vertically aligning of the tool's array of frictional teeth. In order to maintain the tool's teeth in vertical alignment, a plurality of second pin and slide slot combinations are preferably provided for further attaching and suspending the arm's moveable segment and for holding the moveable segment and its array of teeth at the desired vertical alignment. To achieve such alignment, the first and plurality of second pin and slide slot combinations may themselves be vertically arrayed along upper fixed segment of the "U" bracket's oppositely lateral arm.

A plastic column pipe which is to be captured and grasped by the instant inventive tool may weigh several hundred pounds, potentially overstressing a single horizontally extending pin. The inventive tool's preferred provision of the additional plurality of second pin and slide slot combinations beneficially disperses such weight over several of such combination's pins as a guard against tool breakage.

In order to enhance the mechanical simplicity and balance of the instant invention's fixed and moveable arm segments and plural pin and slide slot components, the fixed arm segment may be advantageously configured as or formed to be a ladder frame. An adoption of a ladder frame configuration allows the pin components of the tool's pin and slide slot combinations to comprise ladder rungs which span between a pair of parallel and vertically extending rails. Where such ladder rung functioning pins are provided, the angled or sloped slots of the pin and slot combinations suitably reside at or are formed as voids extending through the arm's moveable segment. Alternatively, where the angled slots are presented upon the fixed segments' parallel rails, the rung configured pins may be fixedly attached to and extend forwardly and rearwardly from the arm's lower moveable segment.

Both of the arms of the "U" bracket may suitably be configured to include a pin and slide slot combination mounted lower moveable segment and, where dual moveable segments are provided, both of such segments preferably present throatwardly or inwardly extending friction enhancing protuberances. However, for purposes of enhancement of mechanical simplicity and cost economies in fabrication of the tool, the provision of a moveable arm segment is preferably restricted to a single "U" bracket arm. The "U" bracket arm which opposes an arm which is adapted to include a pipe clamping moveable segment may beneficially present a matching or mirroring multiplicity of friction enhancing protuberances regardless of whether such opposing arm itself has a moveable segment.

In use of the instant inventive well column pipe retrieval tool, a water well's column pipe may have a break or separation at an elevation within the well's casing substantially below ground level. In order to retrieve such pipe, an operator may initially tie a sturdy rope to the "U" bracket, such rope securely engaging the bracket's upwardly oriented web. Thereafter, the operator may lower the tool into the hollow bore of the well's casing until the lower end of the "U" bracket contacts the broken upper lip or edge of the column pipe. Upon a slight further lowering of the tool, the wall of the column pipe enters the "U" bracket's downwardly opening throat.

Thereafter, the operator may pull upwardly upon the rope, causing the frictional teeth of the "U" bracket arm's moveable segment to securely grip and bind against the wall of the column pipe. The tool's provision of multiplicities of friction enhancing protuberances assures that the gripped or clamped portion of the column pipe's wall maintains structural integrity, avoiding any undesirable re-breaking of the pipe during clamp assisted pipe lifting. The vertically arrayed multiplicities of clamping teeth avoids excess localized clamping pressure against a plastic pipe wall, protecting against further pipe breakage and failure of the pipe retrieval operation.

Accordingly, objects of the instant invention include the provision of a well column pipe retrieval tool which incorporates structures, as described above, and which arranges those structures in relation to each other in manners described above, for the performance of beneficial functions, as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
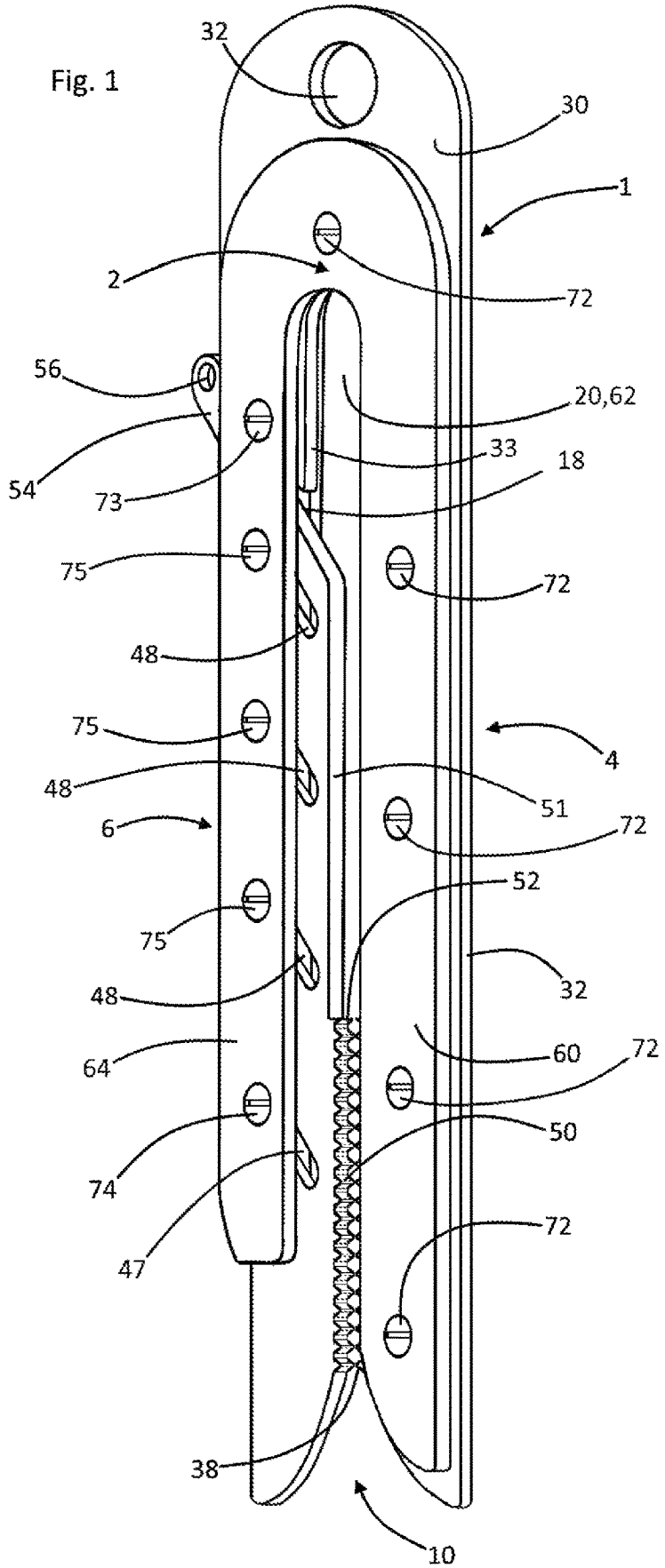
FIG. 1 is a perspective view of a suitable embodiment of the instant inventive well column pipe retrieval tool.

Referring now to the drawings, and in particular to Drawing FIG. 1, a preferred embodiment of the instant inventive well column pipe retrieval tool is referred to generally by Reference Arrow 1. A preferred major structural configuration or shape of the tool 1 is that of an inverted "U" bracket having an upper laterally spanning web 2, a downwardly extending lateral arm 4, and a downwardly extending oppositely lateral arm 6. At the lower or distal ends of the arms 4 and 6 of the "U" bracket, a column pipe receiving opening 10 is formed, such opening preferably including an inverted "V" or carat shaped flair for assisting the receipt and capture of an upper edge of a broken well column pipe.

Figure 2:
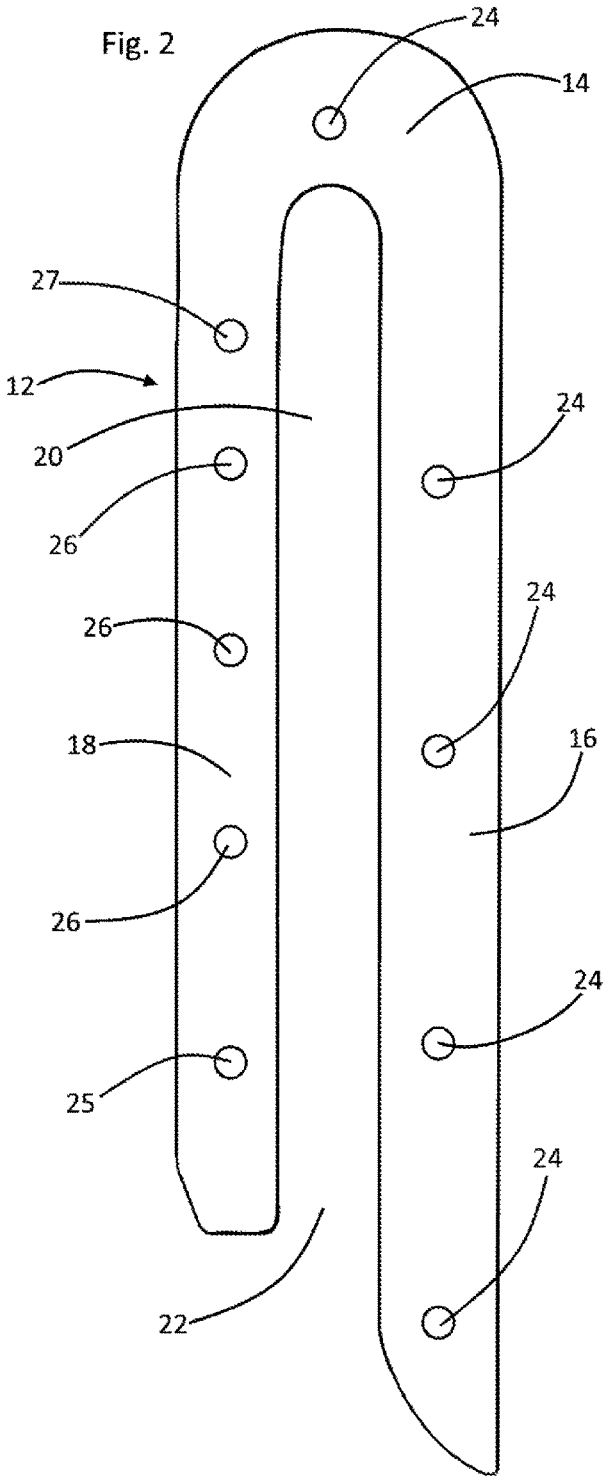
FIG. 2 depicts a disassembled back plate component of the tool of FIG. 1.

Referring simultaneously to FIGS. 1 and 2, the tool's "U" bracket suitably comprises a "U" shaped back plate 12, such plate having an upper laterally extending web 14, and having fixedly attached or wholly formed lateral and oppositely lateral arms 16 and 18. The web 14 in combination with the arms 16 and 18 form, define, and bound a column pipe receiving throat 20 having a lower opening 22. Screw, bolt, or pin receiving eyes 24, 25, 26, and 27 extend through and open at the arms 16 and 18, and through a shortened medial arm 33 which is discussed below.

Figure 5:
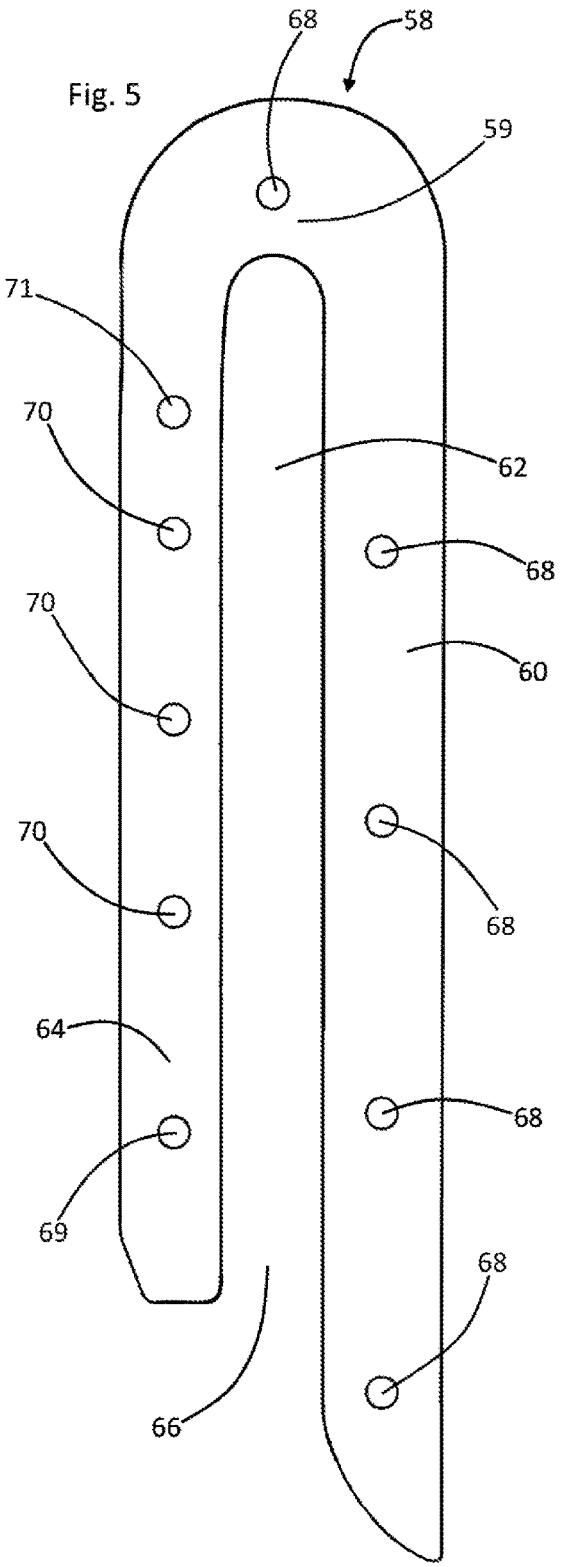
FIG. 5 depicts a disassembled front plate component of the tool of FIG. 1.

Referring further simultaneously to FIG. 5, a "U" shaped front plate 58 is preferably provided, such plate frontwardly mirroring plate 12, such plate including a web 59, lateral and oppositely lateral arms 60 and 64, a throat 62, a lower opening 66, and bolt or pin receiving eyes 68, 69, 70, and 71.

Figure 3:
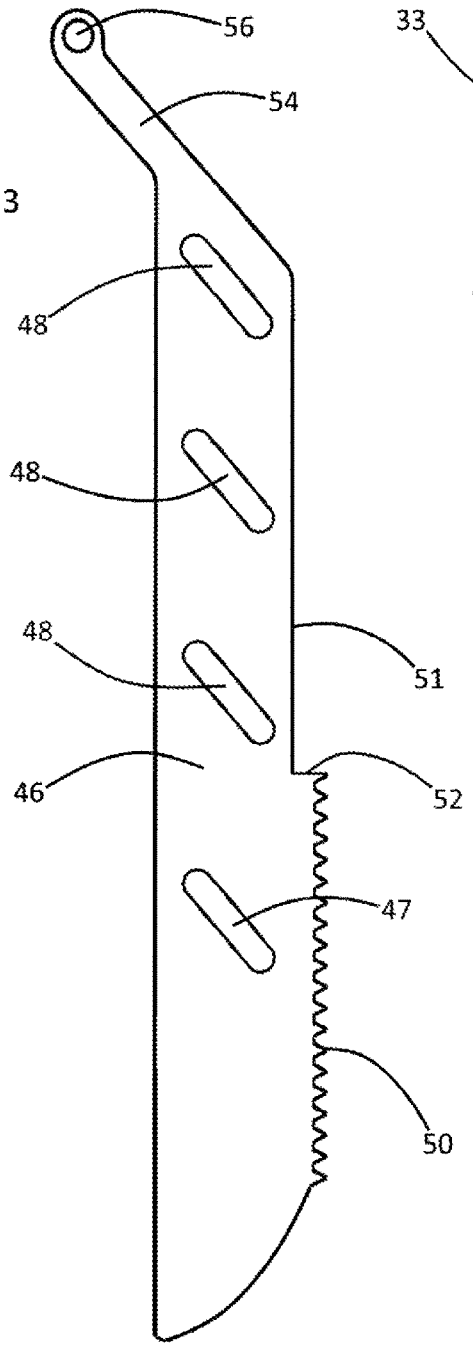
FIG. 3 depicts a disassembled moveable segment of an oppositely lateral "U" bracket arm component of the tool of FIG. 1.
Figure 4:
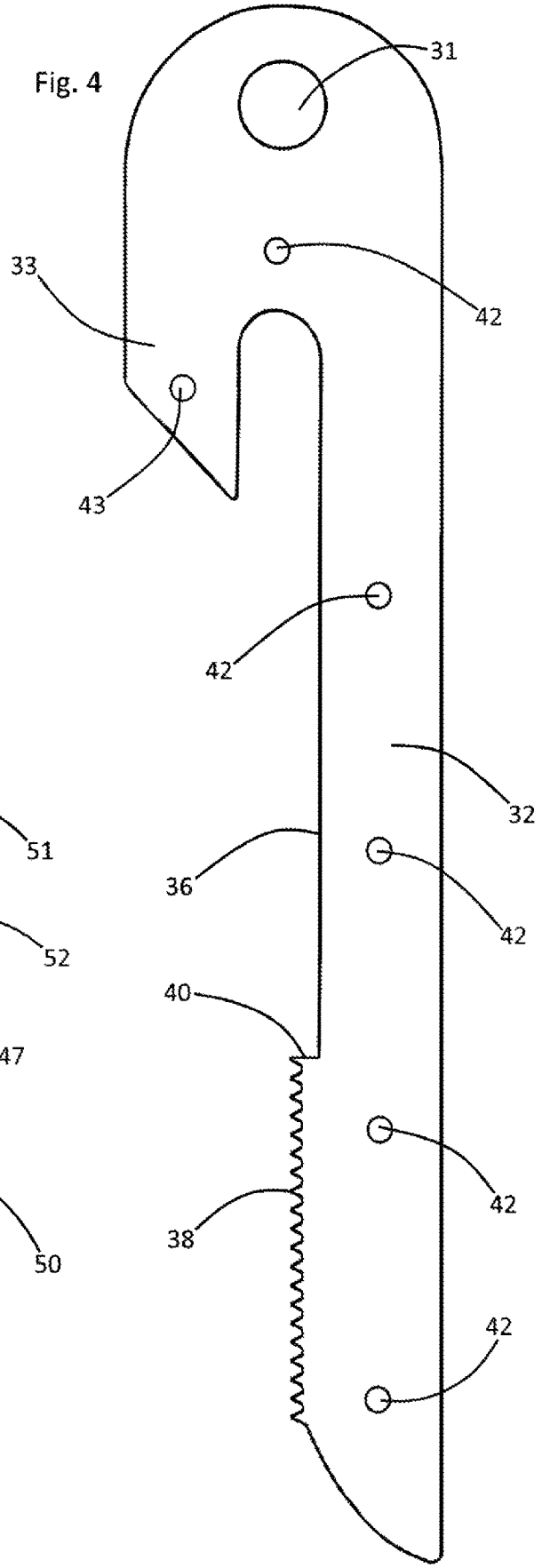
FIG. 4 depicts a disassembled middle plate stratum of a lateral "U" bracket arm component of the tool of FIG. 1.

Referring simultaneously to FIGS. 1, 2, 4, and 5, the lateral arm 4 of the "U" bracket suitably comprises a three element or three plate strata comprising the lateral arm 16 of "U" plate 12, the lateral arm 60 of the "U" plate 58, and an intermediate or middle plate 32. Upon successive stacking of the front plate 58 upon the intermediate plate 32, and of those two plates upon the back plate 12 as indicated in FIG. 1, the bolt or screw receiving eyes 24, 42, and 68 may align, and bolts or screw fasteners 72 may be extended therethrough. Secure screw fastening of such plate stratums 16, 32, and 60 advantageously forms a rigid three layer strata which functionally serves as the "U" bracket's lateral arm 4. Alternatively, the "U" bracket's lateral arm 4 may be seamlessly or wholly formed, or may have individual stratums joined by welding. Where a middle stratum component 32 of the lateral arm 4 is provided, a rope tie loop or eye 32 may be conveniently formed at the upper end of such stratum.

Where the "U" bracket's lateral arm 4 comprises the depicted three layer plate strata, the oppositely lateral arms 18 and 64 of the back and front plates 12 and 58 advantageously present fixed components of or upper segments of the "U" bracket's oppositely lateral arm 6. Referring further to FIG. 3, to complete the "U" bracket's oppositely lateral arm 6, a lower moveable arm segment or plate 46 is preferably provided, such segment 46 being interstitially received between the oppositely lateral arms 18 and 64 of "U" plates 12 and 58.

At least a first pin and angled slide slot combination is preferably provided for moveably mounting the moveable arm segment 46 at the lower end of the fixed arm segment 18,64, the pin component of such combination suitably comprising a rearwardly extending screw or bolt 74 and an angled slide slot 47 which extends through the segment 46. Such screw or bolt 74 extends rearwardly through eye 25, and further extends rearwardly through angled slot 47, to finally enter and anchor at eye 69.

It may be observed that the oppositely lateral end of slot 47 is raised above or is positioned substantially higher than such slot's lateral end. The height differential between the ends of slot 47 allows the upper wall of such slot to serve as a slide ramp actuator. In operation, the downwardly directed weight of the moveable segment 46 advantageously causes the entire segment 46 to slidably move downwardly and inwardly with respect to the "U" bracket's upper fixed segment 18,64. During such motion, the bolt or screw 74 acts as a slide pin. In a suitable embodiment, slot 47 is angled approximately 45° from horizontal.

In order to hold the moveable segment 46 in substantially parallel alignment with the lateral arm 4 and with the fixed segments 18 and 64 of the oppositely lateral arm 6, a plurality of second pin and slide slot combinations are preferably provided. In such combinations, angled slots 48 suitably receive screw/slide pins 75 which extend rearwardly through eyes 70 to rearwardly anchor within eyes 26.

The instant invention's arrangement of the fixed segment of the oppositely lateral "U" bracket arm to include parallel plate arms 64 and 18 and to comprise screw pins 74 and 75 spanning therebetween, advantageously configures the upper portion of the oppositely lateral arm 6 as a ladder frame. In such framework, the ladder's rails comprise "U" plate arms 18 and 64, and the ladder's rungs comprise screws or slide pins 74 and 75.

Figure 6:
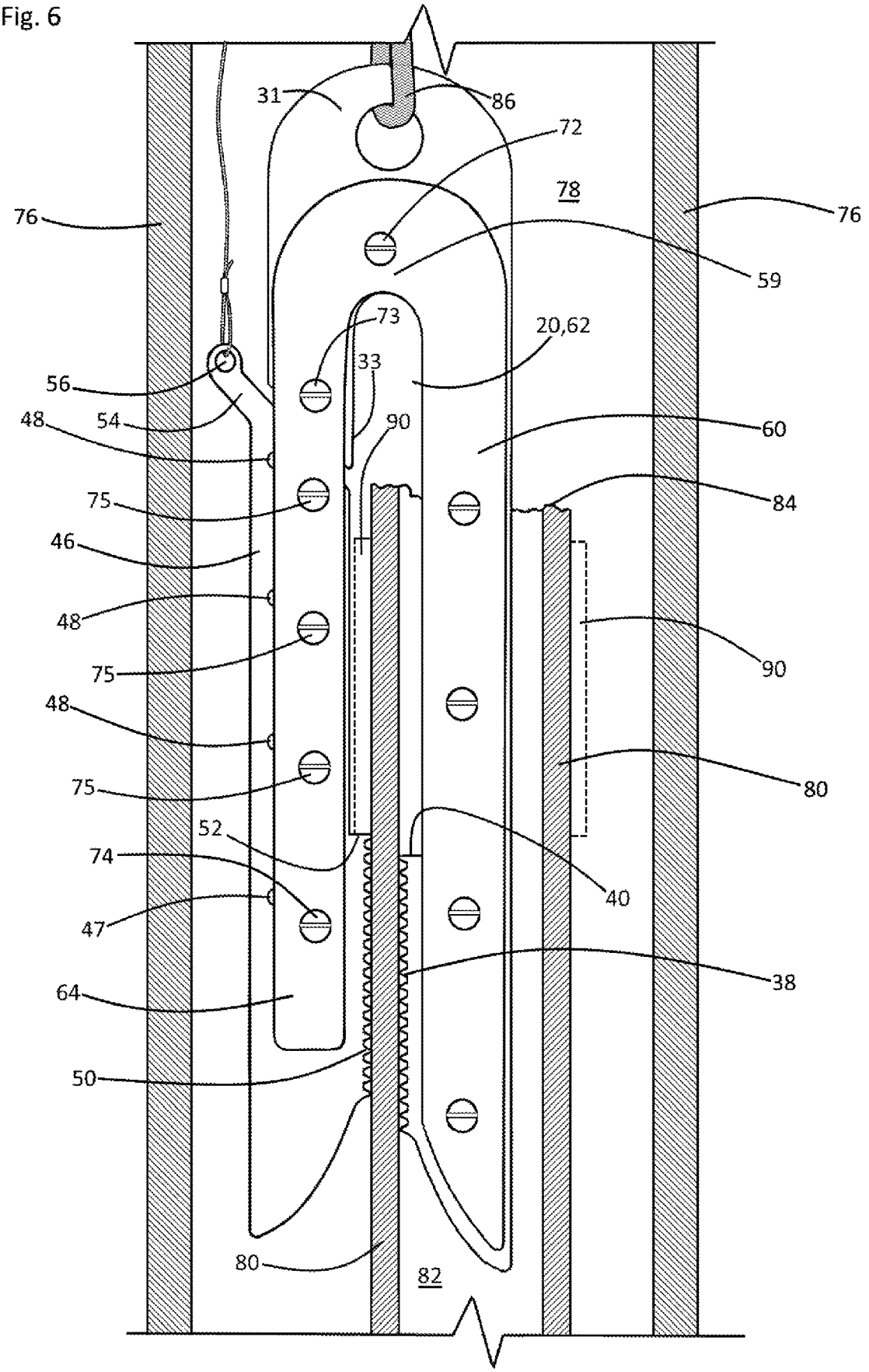
FIG. 6 presents a front view of a tool of FIG. 1, the view showing the tool in use in retrieval of a broken column pipe within a well casing.

Referring to FIGS. 1 and 6, a water well's column pipe 80 may have a break 84 below ground level within the bore 78 of the well's casing 76. To retrieve the column pipe 80 from the bore 78, an operator of the tool 1 may tie a strong rope 86 to the tool's suspension eye 31. The operator may also attach a strong tether line 86 to a pull eye 56 which is formed at the distal end of a release arm 54, such arm extending oppositely laterally from the oppositely lateral ends or edges of the fixed and moveable segments of the tool's oppositely lateral arm 6.

Thereafter, the operator may lower the tool 1 into the casing's bore 78. The operator preferably has preliminarily gauged or measured the vertical distance between the column pipe's break 84 and the upper opening of the casing 76. Accordingly, the operator knows the length of downward extension of the rope 86 as at which the desired engagement of the tool 1 with the column pipe 80 must occur. In some circumstances, the entire tool 1 may improperly pass downwardly beyond the break 84 and into the annulus surrounding the column pipe 80. However, such improper downward passage may be readily detected by the operator when the downward dispensation of the rope 86 into the well bore 78 exceeds the gauged depth of the break 84. Upon such improper downward passage, the operator may simply raise the tool to attempt a next successive downward extension toward the break 84.

Upon a properly vertically aligned downward extension of the tool 1, the broken upper lip 84 of the column pipe 80 initially enters the throat 20,62 of the "U" bracket via its inverted "V" shaped or flared lower opening 10. While the upper lip of the column pipe 80 progressively passes upwardly along the throat 20,62, any impingement of the column pipe 80 with the moveable segment or plate 46 slidably moves such plate upwardly and oppositely laterally away from the column pipe. Accordingly, during the initial engagement of the tool 1 with the column pipe 80, the pin and slide channel combination interconnections between the "U" bracket's fixed and moveable segments operatively prevent interference by the moveable segment with the tool's engagement with the column pipe 80.

The downward progress of the tool's engagement with the column pipe is suitably stopped at the vertical position indicated in FIG. 6, and such downward progress may continue until the broken upper lip 84 contacts the tool's web 2,14,59. Upon receipt of the column pipe's wall within the tool's throat 20,62, the moveable segment or plate 46 of the oppositely lateral arm 6 automatically slidably moves under the force of gravity downwardly and inwardly with respect to the throat 20,62 and with respect to the column pipe wall within such throat. Such downward and inward motion continues until the plate 46 contacts the column pipe 80.

In order to enhance pipe holding friction at such plate 46 to wall 80 contact, a multiplicity of protuberances are preferably fixedly attached to or are formed wholly with the oppositely lateral arm's moveable segment or plate 46, such protuberances preferably extending laterally from such plate's lateral edge 51. In a preferred embodiment, such protuberances take the form of a multiplicity of "V" or carat shaped teeth or ridges 50. The lateral arm 4 may similarly present a multiplicity of teeth 38 which are preferably formed wholly with and extend oppositely laterally from the oppositely lateral edge 36 of the lateral arm's middle stratum plate 32. Opposing frictional contacts between teeth 50 and 38 and the wall of column pipe 80 tend to forcefully draw the plate 46 along with its teeth 50 laterally against the pipe 80, securely binding against and clamping such pipe. Vertical multiplications of the teeth 50 and 38 prevents excess localized clamping pressure of any single tooth.

Upon achieving such clamping engagement, the column pipe 80 may be towed upwardly out of the casing's bore 78. While the column pipe 80 downwardly suspends from the tool 1 during such upward towing, the weight of such pipe bears against the sloped lower surfaces of the angled slots 47 and 48. During such towing and tool suspension, a lateral vector component of the weight force imposed by the suspended pipe tends to apply a forceful splaying force against the "U" bracket's arms. In order to allow the middle plate 32 to assist in resisting such arm splaying force, a shortened oppositely lateral arm 33 may be advantageously provided, such arm extending downwardly from the oppositely lateral end of the middle plate's web 30. The screw or bolt 73 which extends through aligned eyes 71, 43, and 27 joins such shortened arm 33 with "U" plate arms 64 to assist those arms in their resistance against splaying of the "U" bracket's arms.

In order to disengage the teeth 50 and 38 from the column pipe 80, an upward pulling force may be applied to the moveable segment or plate 46 via the tether 88 which is attached at the eye 56 which is formed at the distal end of the release arm 54.

Sleeve hooking shoulders 52 and 40 are preferably formed at the inner surfaces or edges 51 and 36 of the moveable segment or plate 46 and the lateral arm's middle stratum 32. Where the tool's lateral arm 4 enters the hollow bore 82 of the column pipe 80, as depicted, and where such pipe presents an annular sleeve coupler 90 (shown in dashed lines), shoulder 52 may engage the lower surface of such sleeve 90 as an alternative means for holding and suspending the column pipe 80. Alternatively, where the tool's oppositely lateral arm 6 enters bore 82 (configuration not depicted within views) shoulder 40 may similarly engage such sleeve lower surface.

While the principles of the invention have been made clear in the above illustrative embodiment, those skilled in the art may make modifications to the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. A well column pipe retrieval tool comprising:

(a) a "U" bracket having a lateral arm and an oppositely lateral arm, wherein the oppositely lateral arm comprises a fixed segment having a lower end, wherein the oppositely lateral arm comprises a moveable segment having a lower end, and wherein the lower end of the moveable segment is below the lower end of the fixed segment;

(b) a column pipe receiving throat, said throat being laterally bounded by the "U" bracket's lateral arm, and said throat being oppositely laterally bounded by the oppositely lateral arms' moveable segment; and (c) at least a first pin and slide slot combination interconnecting the oppositely lateral arm's fixed and moveable segments.

2. The well column pipe retrieval tool of claim 1 further comprising an oppositely lateral multiplicity of friction enhancing protuberances, each protuberance among said multiplicity of protuberances extending laterally from the oppositely lateral arm's moveable segment.

3. The well column pipe retrieval tool of claim 2 further comprising a plurality of second pin and slide slot combinations, each combination among the plurality of second pin and slide slot combinations further interconnecting the oppositely lateral arm's fixed and moveable segments.

4. The well column pipe retrieval tool of claim 3 wherein each of the pin and slide slot combinations' slide slots has a lateral end and an oppositely lateral end, and wherein the lateral end of said each slide slot is lower than the oppositely lateral end of said each slide slot.

5. The well column pipe retrieval tool of claim 2 further comprising an oppositely lateral sleeve hooking shoulder overlying the oppositely lateral multiplicity of friction enhancing protuberances.

6. The well column pipe retrieval tool of claim 1 wherein each arm among the lateral and oppositely lateral arms has a lower end, and further comprising a "V" channel formed at said ends.

7. A well column pipe retrieval tool comprising:

(a) a "U" bracket having a lateral arm and an oppositely lateral arm, wherein the oppositely lateral arm comprises a fixed segment and a moveable segment;

(b) a column pipe receiving throat, said throat being laterally bounded by the "U" bracket's lateral arm, and said throat being oppositely laterally bounded by the oppositely lateral arms' moveable segment; and (c) at least a first pin and slide slot combination interconnecting the oppositely lateral arm's fixed and moveable segments, wherein the oppositely lateral arm's fixed segment comprises a ladder frame having a front rail, a rear rail, and a plurality of rungs spanning between the front and rear rails, and wherein each of the pin and slide slot combinations' pins comprises one of the ladder frame's rungs.

8. The well column pipe retrieval tool of claim 7 further comprising a lateral multiplicity of friction enhancing protuberances, wherein each protuberance among the lateral multiplicity of friction enhancing protuberances extends oppositely laterally from the "U" bracket's lateral arm.

9. The well column pipe retrieval tool of claim 8 further comprising suspending means connected operatively at an upper end of the "U" bracket.

10. The well column pipe retrieval tool of claim 9 further comprising a release arm fixedly attached to or formed wholly with the oppositely lateral arm's moveable segment, wherein the ladder frame's rails have oppositely lateral ends, and wherein the release arm extends oppositely laterally from said oppositely lateral ends.

11. The well column pipe retrieval tool of claim 10 wherein the release arm has a distal end, and further comprising pulling means fixedly attached to or formed wholly with said distal end.

12. The well column pipe retrieval tool of claim 8 wherein the "U" bracket's lateral arm comprises a plate strata.

13. The well column pipe retrieval tool of claim 12 wherein the plate strata comprises a front stratum, a rear stratum, and a middle stratum positioned between the front and rear stratums.

14. The well column pipe retrieval tool of claim 13 wherein said each protuberance among the lateral multiplicity of friction enhancing protuberances further extends from the plate strata's middle stratum.

15. The well column pipe retrieval tool of claim 8 further comprising a lateral sleeve hooking shoulder overlying the lateral multiplicity of friction enhancing protuberances.

* * * * *